US010260322B2

(12) United States Patent
Brewer et al.

(10) Patent No.: US 10,260,322 B2
(45) Date of Patent: Apr. 16, 2019

(54) LUBRICATOR AUTO-CATCH

(71) Applicant: PRIORITY ARTIFICIAL LIFT SERVICES, LLC, Houston, TX (US)

(72) Inventors: Daniel J. Brewer, Cypress, TX (US); Roddy W. Simpson, Jr., Highlands, TX (US); Joseph E. Kutac, Magnolia, TX (US); Robert M. Wilkerson, San Angelo, TX (US)

(73) Assignee: PRIORITY ARTIFICIAL LIFT SERVICES, LLC, Houston, TX (US)

( * ) Notice: Subject to any disclaimer, the term of this patent is extended or adjusted under 35 U.S.C. 154(b) by 277 days.

(21) Appl. No.: 15/339,674

(22) Filed: Oct. 31, 2016

(65) Prior Publication Data

US 2017/0122084 A1 May 4, 2017

Related U.S. Application Data

(60) Provisional application No. 62/249,670, filed on Nov. 2, 2015.

(51) Int. Cl.
*E21B 33/068* (2006.01)
*E21B 43/12* (2006.01)

(52) U.S. Cl.
CPC ..... *E21B 43/121* (2013.01); *E21B 33/068* (2013.01)

(58) Field of Classification Search
CPC ..... E21B 43/121
See application file for complete search history.

(56) References Cited

U.S. PATENT DOCUMENTS 3,095,819 A * 7/1963 Brown ..... F04B 47/12 137/624.11
3,147,808 A * 9/1964 McCarvell ..... E21B 37/04 15/104.061
3,351,021 A * 11/1967 Moore, Jr. ..... E21B 43/122 417/57
4,211,279 A * 7/1980 Isaacks ..... E21B 33/068 166/106
4,465,435 A * 8/1984 Copas ..... F04B 47/12 417/56
5,253,713 A * 10/1993 Gregg ..... E21B 33/068 166/372
2006/0108126 A1* 5/2006 Horn ..... E21B 43/121 166/386
2015/0176377 A1* 6/2015 Agarwal ..... E21B 43/121 166/372

* cited by examiner

*Primary Examiner* — Robert E Fuller
(74) *Attorney, Agent, or Firm* — Adolph Locklar

(57) ABSTRACT

A plunger catch assembly for a lubricator includes a catch housing and catch end cap. The catch housing and catch end cap form a dart cylinder and a diaphragm cylinder. The dart cylinder allows a dart positioned at least partially therein to slidingly and selectively extend into the lubricator to catch a plunger. The dart may be coupled to a diaphragm by a spring and spring plate. The plunger catch assembly may be reconfigurable between a pneumatic configuration and a manual configuration. The end cap may include a machine thread for coupling a handle assembly and a pneumatic coupler for coupling a pneumatic line.

20 Claims, 6 Drawing Sheets

LUBRICATOR AUTO-CATCH

CROSS-REFERENCE TO RELATED APPLICATIONS

This application is a non-provisional application which claims priority from U.S. provisional application No. 62/249,670, filed Nov. 2, 2015.

TECHNICAL FIELD/FIELD OF THE DISCLOSURE

The present disclosure relates generally to artificial lift devices, and specifically to lubricators for plunger lift artificial lift devices.

BACKGROUND OF THE DISCLOSURE

When producing a gas well, the buildup of liquids within the production tubing may cause a reduction in produced gas flow. In order to remove the liquid from the production tubing, artificial lift techniques may be utilized. One such technique is plunger lift, in which a plunger is traveled through the production tubing to remove the liquid buildup, referred to herein as a liquid slug. The plunger is typically a length of metal such as steel which fits within the production tubing. The plunger may include one or more seals positioned therearound to at least partially seal against the production tubing. When sufficient gas is produced without a liquid slug in the production tubing, the plunger may remain generally within a lubricator positioned at the wellhead. The plunger may remain suspended in the lubricator because of the pressure exerted by the flow of liquids and gases on the lower surface of the plunger which results in a force on the plunger greater than the weight of the plunger. Alternatively, the plunger may be retained in place in the lubricator by a catch. When sufficient liquid has formed such as to produce a liquid slug, the outlet of the wellhead may be closed and, where used, the catch released allowing the plunger to descend through the production tubing and through the liquid slug. The outlet is kept closed long enough such that the pressure in the production casing increases from gas in the formation. Once a sufficient pressure is reached, the outlet may be opened, lowering the pressure in the production tubing above the plunger, causing it to rise to the surface. The liquid slug above the plunger is brought to the surface with the plunger. At the surface, the plunger may be retained within the lubricator by fluid pressure or by the catch.

SUMMARY

The present disclosure provides for a plunger catch assembly for a lubricator. The plunger catch assembly may include a dart selectively extendable into the lubricator to catch a plunger. The plunger catch assembly may further include a catch housing. The catch housing may be coupleable to the lubricator. The catch housing may define a dart cylinder. The dart may be slidingly positioned at least partially within the dart cylinder. The plunger catch assembly may further include a catch end cap coupleable to the catch housing. The catch housing and catch end cap may form a diaphragm cylinder therein. The catch end cap may include a machine thread adapted to receive a handle assembly and a pneumatic line coupler adapted to couple to a pneumatic line. The plunger catch assembly may further include a diaphragm. The diaphragm may be slidingly positioned within the diaphragm cylinder. The diaphragm may be coupled to the dart such that movement of the diaphragm causes corresponding movement of the dart. The diaphragm may be adapted to move in response to a mechanical force from the handle assembly or a fluid pressure within the diaphragm cylinder from the pneumatic line.

The present disclosure also provides for a method. The method may include providing a lubricator having a plunger catch assembly coupled thereto. The plunger catch assembly may include a dart selectively extendable into the lubricator to catch a plunger. The plunger catch assembly may further include a catch housing coupled to the lubricator. The catch housing may define a dart cylinder. The dart may be slidingly positioned at least partially within the dart cylinder. The plunger catch assembly may further include a catch end cap coupled to the catch housing. The catch housing and catch end cap may form a diaphragm cylinder therein. The plunger catch assembly may further include a diaphragm. The diaphragm may be slidingly positioned within the diaphragm cylinder. The diaphragm may be coupled to the dart such that movement of the diaphragm causes corresponding movement of the dart. The diaphragm may be adapted to move in response to a mechanical force from the handle assembly or a fluid pressure within the diaphragm cylinder from the pneumatic line. The plunger catch assembly may further include a handle assembly operably coupled to a machine thread formed in the catch end cap. The method may further include removing the catch end cap from the catch housing. The method may further include removing the handle assembly from the catch end cap. The method may further include coupling the pneumatic line to a pneumatic line coupler formed in the catch end cap. The method may further include recoupling the catch end cap to the catch housing.

The present disclosure also provides for a method. The method may include providing a lubricator having a plunger catch assembly coupled thereto. The plunger catch assembly may include a dart selectively extendable into the lubricator to catch a plunger. The plunger catch assembly may further include a catch housing coupled to the lubricator. The catch housing may define a dart cylinder. The dart may be slidingly positioned at least partially within the dart cylinder. The plunger catch assembly may further include a catch end cap coupled to the catch housing. The catch housing and catch end cap may form a diaphragm cylinder therein. The plunger catch assembly may further include a diaphragm. The diaphragm may be slidingly positioned within the diaphragm cylinder. The diaphragm may be coupled to the dart such that movement of the diaphragm causes corresponding movement of the dart. The diaphragm may be adapted to move in response to a mechanical force from the handle assembly or a fluid pressure within the diaphragm cylinder from the pneumatic line. The plunger assembly may further include a pneumatic line coupled to a pneumatic line coupler formed in the catch end cap. The method may further include removing the catch end cap from the catch housing. The method may further include removing the pneumatic line from the catch end cap. The method may further include coupling a handle assembly to a machine thread formed in the catch end cap. The method may further include recoupling the catch end cap to the catch housing.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
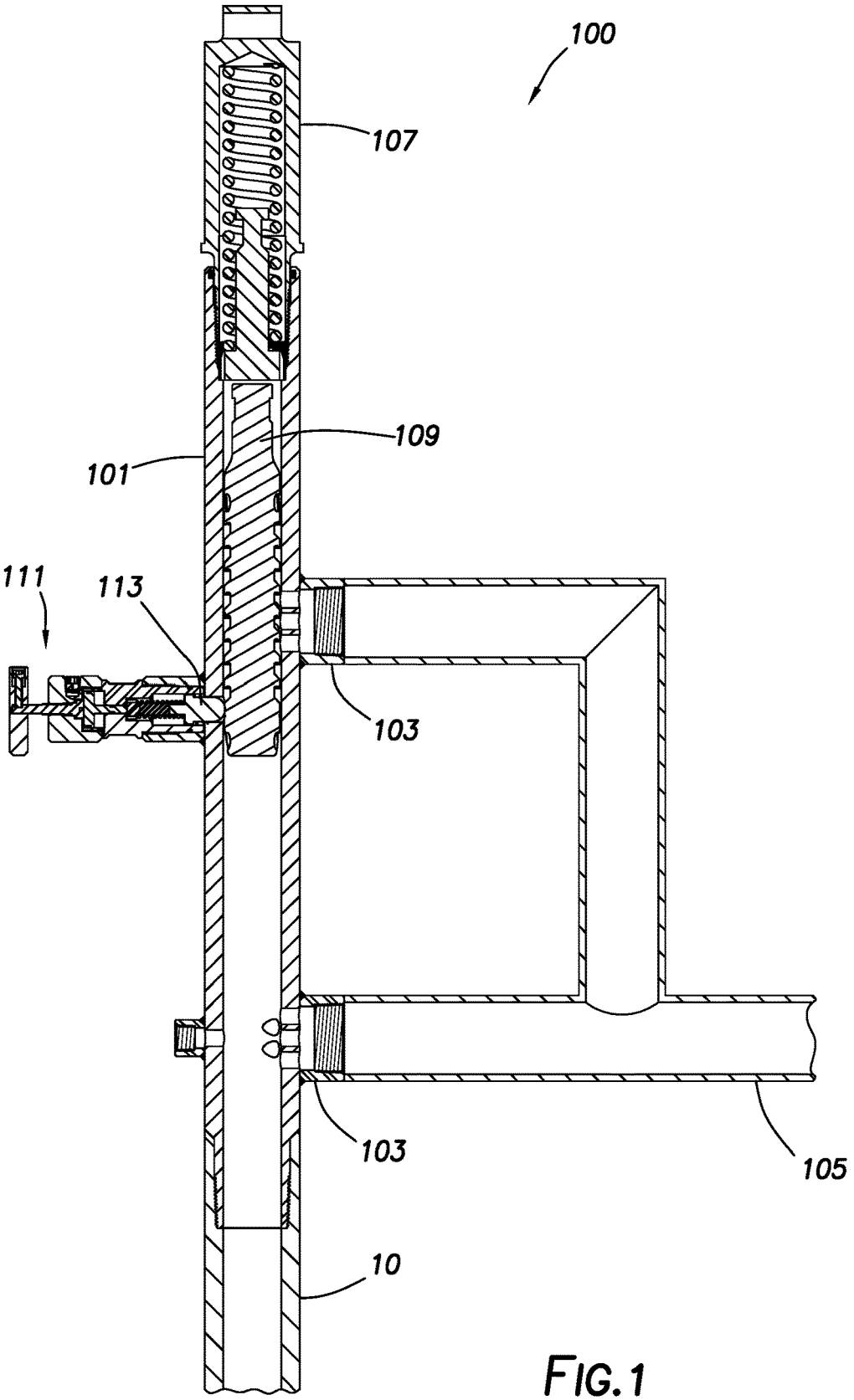
FIG. 1 depicts a cross section view of a lubricator having a plunger catch consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As depicted in FIG. 1, lubricator 100 may include lubricator housing 101. Lubricator housing 101 may be generally tubular and may be adapted to couple to production wellbore 10. As understood in the art, production wellbore 10 may include one or more of production casing, production tubing, or any other tubular members and valves adapted to couple between a producing formation and a wellhead, in this case lubricator 100. Lubricator 100 may include one or more outlet ports 103 adapted to allow produced gases and liquids to flow out of production wellbore 10 and into flow line 105 through which the gases and liquids flow to be stored or further processed. Lubricator 100 may further include lubricator cap 107, adapted to, for example and without limitation, retain pressure within lubricator 100. Lubricator cap 107 may be threadedly coupled to lubricator housing 101 to allow for, for example and without limitation, disassembly of lubricator 100 as discussed herein below. Lubricator 100 may further include plunger catch assembly 111. Plunger catch assembly 111 may be coupled to lubricator housing 101. Plunger catch assembly 111 may include dart 113 which extends into the interior of lubricator housing 101 to support plunger 109 within lubricator 100. Plunger catch assembly 111 may couple to lubricator housing 101 by, for example and without limitation, a threaded connection between threads formed on lubricator housing 101 and plunger catch assembly 111.

When gas is being produced or when it is desired to access plunger 109, plunger 109 may be retained within lubricator 100 as depicted in FIG. 1. In some installations, plunger 109 may be retained within lubricator 100 by the hydraulic pressure of the produced gases and liquids when gas is being produced. In some embodiments, plunger 109 may be retained by plunger catch assembly 111 when gas is being produced. Likewise, when access to plunger 109 is desired, plunger catch assembly 111 may be used to retain plunger 109 within lubricator 100 by extending dart 113 to engage a portion of plunger 109.

Figure 2:
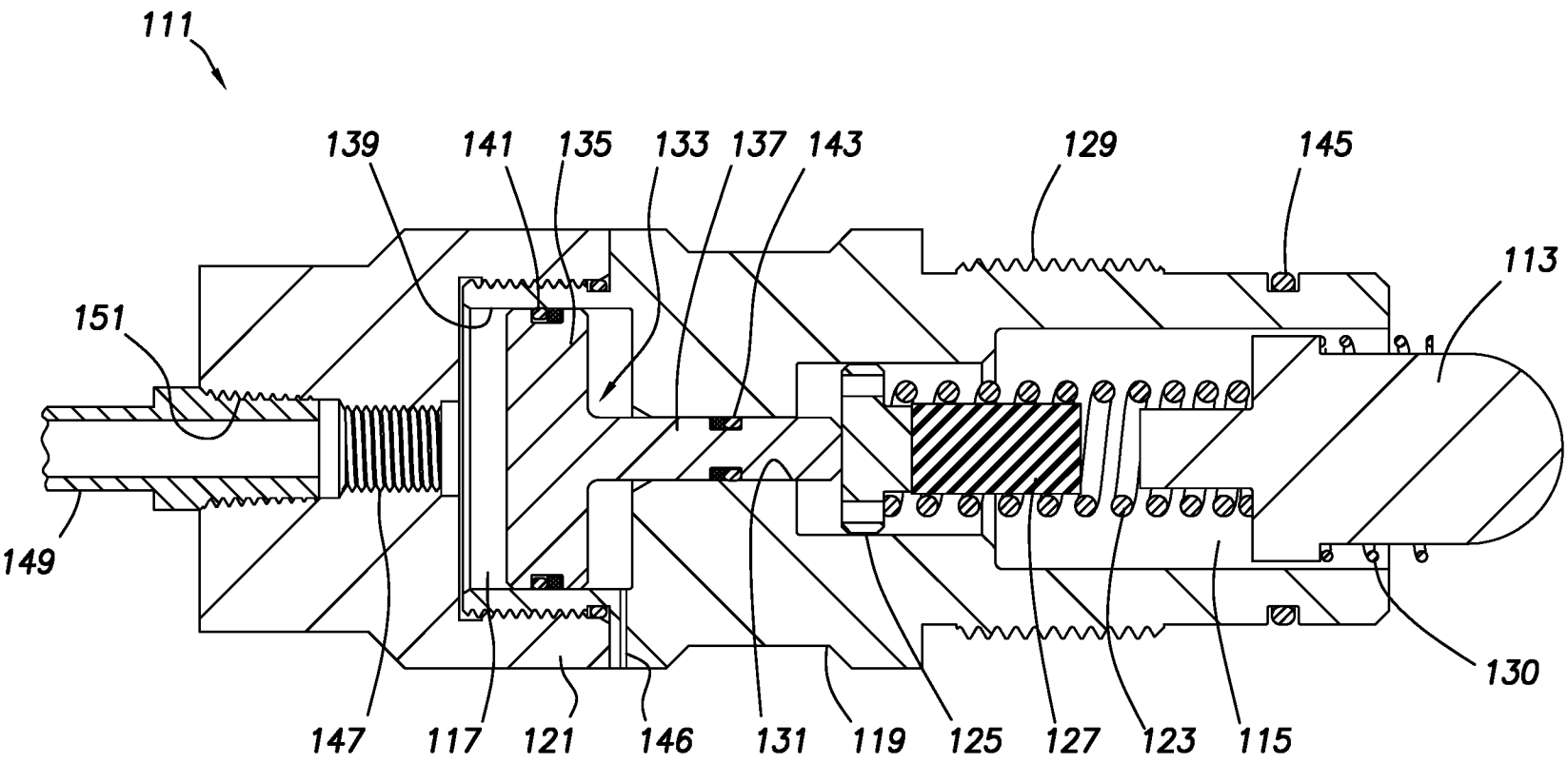
FIG. 2 depicts a cross section of a plunger catch consistent with at least one embodiment of the present disclosure in a pneumatic configuration.
Figure 3:
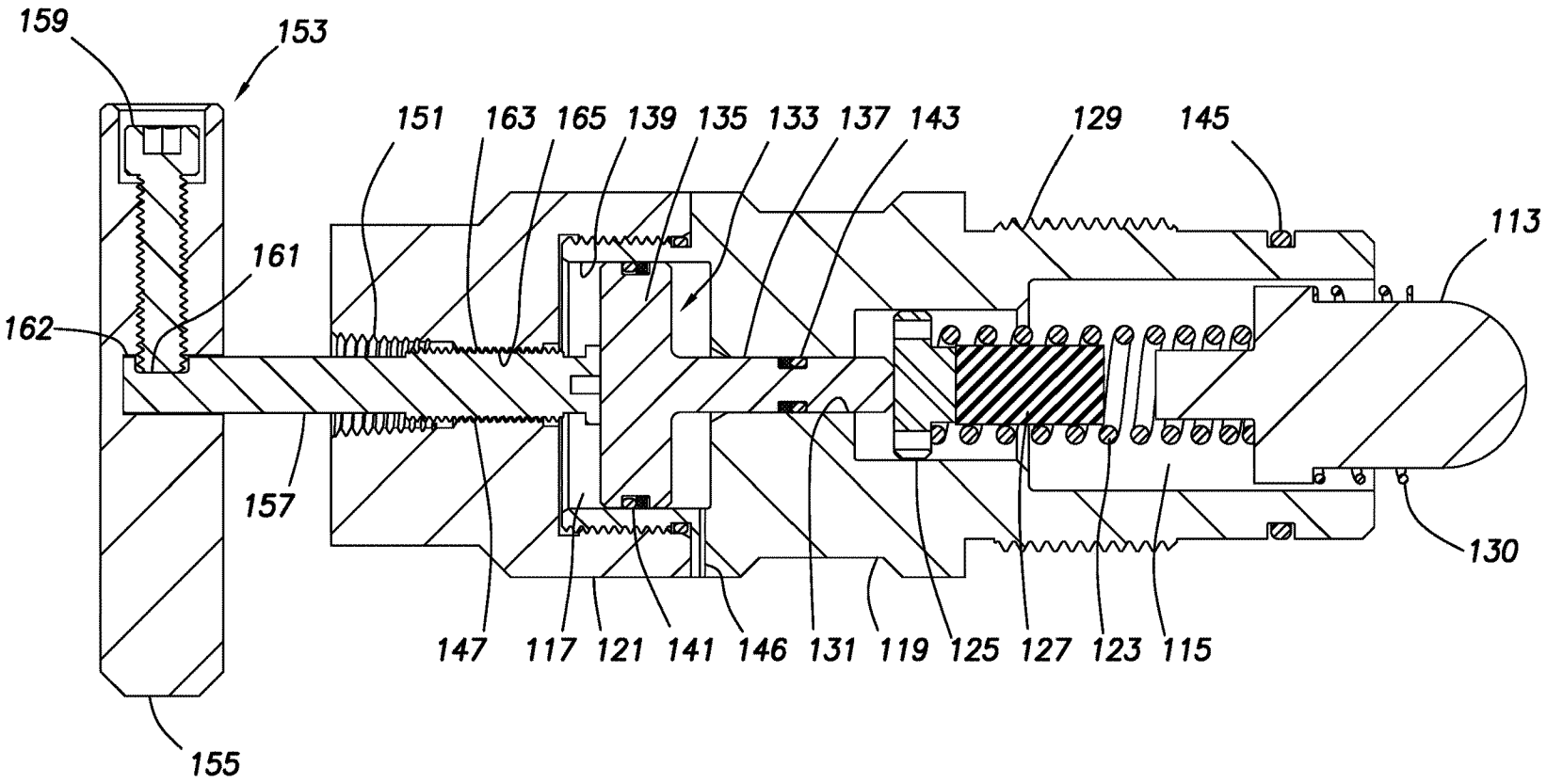
FIG. 3 depicts a cross section of the plunger catch of FIG. 2 in a manual configuration.

As depicted in detail in FIGS. 2, 3, plunger catch assembly 111 may be adapted to selectively extend or retract dart 113. In some embodiments, plunger catch assembly may include dart cylinder 115 and diaphragm cylinder 117. Dart cylinder 115 and diaphragm cylinder 117 may be formed within one or more housings, depicted in FIGS. 2, 3 as, for example and without limitation, catch housing 119 and catch end cap 121. One having ordinary skill in the art with the benefit of this disclosure will understand that the specific housing arrangement described herein is merely exemplary and that other configurations may be utilized without deviating from the scope of the present disclosure.

Dart 113 may be slidingly positioned at least partially within dart cylinder 115 formed in catch housing 119. In some embodiments, spring 123 may be positioned between spring plate 125 and dart 113 such that movement of spring plate 125 may cause a corresponding movement of dart 113 via spring 123. In some embodiments, elastomeric shock absorber 127 may be positioned between spring plate 125 and dart 113 to, for example and without limitation, damp any contact between spring plate 125 and dart 113. In some embodiments, catch housing 119 may include threads 129 adapted to mesh with corresponding threads formed in lubricator housing 101 to couple plunger catch assembly 111 to lubricator 100. In some embodiments, return spring 130 positioned between dart 113 and lubricator housing 101 may cause retraction of dart 113 when spring plate 125 is retracted as discussed below.

In some embodiments, catch housing 119 may further form diaphragm cylinder 117. Diaphragm cylinder 117 may be positioned at an end of catch housing 119 opposite dart 113. In some embodiments, diaphragm cylinder 117 may be connected to dart cylinder 115 by connector port 131. Diaphragm cylinder 117 may be adapted to house diaphragm 133, in sliding, sealing contact with diaphragm cylinder walls 139. Diaphragm 133 may include diaphragm head 135 and diaphragm shank 137. Diaphragm shank 137 may pass through connector port 131 and may be in contact with spring plate 125 such that movement of diaphragm 133 causes corresponding movement of spring plate 125 via diaphragm shank 137. In some embodiments, catch end cap 121 may be coupled and sealed to catch housing 119 such that catch end cap 121 forms an end of diaphragm cylinder 117. Catch end cap 121 may thus retain diaphragm 133 within diaphragm cylinder 117.

In some embodiments, diaphragm 133 may act as a piston within diaphragm cylinder 117. In some such embodiments, one or more piston seals 141 may be positioned between diaphragm head 135 and diaphragm cylinder walls 139. In some embodiments, one or more shank seals 143 may be positioned between diaphragm shank 137 and connector port 131 to, for example and without limitation, seal dart cylinder 115. In some embodiments, external seals 145 may seal between catch housing 119 and lubricator housing 101. In some embodiments, dart cylinder 115 may be fluidly coupled to the interior of lubricator 100, and shank seals 143 and external seals 145 may thus retain pressure from the wellbore 10 within lubricator 100. In some embodiments, diaphragm cylinder 117 may include weep hole 146 adapted to allow pressure equalization within diaphragm cylinder 117 when diaphragm 133 moves as discussed herein below.

In some embodiments, catch end cap 121 may include control aperture 147. Control aperture 147 may be positioned at an end of catch end cap 121 opposite the connection to catch housing 119. Control aperture 147 may be adapted to allow one or more control mechanisms to couple to catch end cap 121 and provide access to the interior of diaphragm cylinder 117. In some embodiments, control aperture 147 may include one or more couplers adapted to couple to the different control mechanisms. By changing the control mechanism coupled to catch end cap 121, plunger catch assembly 111 may be reconfigured between different control configurations. In some embodiments, plunger catch assembly 111 may be configured in a pneumatic configuration or in a manual configuration as discussed below.

In some embodiments, when plunger catch assembly 111 is configured in a pneumatic configuration as depicted in FIG. 2, pneumatic line 149 may be coupled to control aperture 147 of catch end cap 121. In some embodiments, catch end cap 121 may include pneumatic line coupler 151. In some such embodiments, pneumatic line coupler 151 may be a standard pneumatic coupling such as a NPT threaded port adapted to allow direct coupling to a NPT coupler on pneumatic line 149.

In such a configuration, pressure applied within diaphragm cylinder 117 between catch end cap 121 and diaphragm 133 may cause diaphragm 133 to move towards dart 113, thus causing extension of dart 113 into the interior of lubricator 100 via diaphragm shank 137, spring plate 125, and spring 123. Dart 113 may thus be controlled by pneumatic pressure applied by pneumatic line 149. One having ordinary skill in the art with the benefit of this disclosure will understand that any control apparatus for controlling pneumatic actuators may be used with plunger catch assembly 111 to actuate dart 113. In some embodiments, when pressure is bled from diaphragm cylinder 117, return spring 130 may cause retraction of dart 113. In some embodiments, diaphragm cylinder 117 weep hole 146 may allow air to reenter diaphragm cylinder 117 as diaphragm 133 retracts.

In some embodiments, when plunger catch assembly 111 is configured in a manual configuration as depicted in FIG. 3, handle assembly 153 may be coupled to catch end cap 121. Handle assembly 153 may include handle 155 and adjusting pin 157. In some embodiments, handle may be releasably coupled to adjusting pin by retaining bolt 159. Retaining bolt 159 may be adapted to engage land 161 formed on adjusting pin, such that when retaining bolt 159 is tightened, handle 155 is mechanically linked to adjusting pin 157 allowing for manual rotation of handle 155 to rotate adjusting pin 157. When retaining bolt 159 is loosened, handle 155 may be decoupled from adjusting pin 157 such that rotation of handle 155 does not rotate adjusting pin 157. In some embodiments, handle 155 may be fully removed from adjusting pin 157 when retaining bolt 159 is loosened. In some embodiments, adjusting pin 157 may include retaining lip 162 at the end of land 161 positioned to retain handle 155 on adjusting pin 157 when retaining bolt 159 is tightened.

In some embodiments, adjusting pin 157 may include external threads 163 which may mesh with machine threads 165 formed in control aperture 147 of catch end cap 121. Catch end cap 121 may thus include both pneumatic line coupler 151 with NPT threads and machine threads 165. Although described and depicted as being coaxial, one having ordinary skill in the art with the benefit of this disclosure will understand that NPT threads of pneumatic line coupler 151 and machine threads 165 may be arranged such that they are not coaxial as discussed herein below. Additionally, one having ordinary skill in the art with the benefit of this disclosure will understand that pneumatic line coupler 151 and machine threads 165 may be formed as separate openings into catch end cap 121 without deviating from the scope of this disclosure. By rotating handle 155 engaged with adjusting pin 157, adjusting pin 157 may enter into or retract from diaphragm cylinder 117 and may engage diaphragm 133. Rotation of handle 155 when plunger catch assembly 111 is configured in the manual configuration may thus extend dart 113 via adjusting pin 157, diaphragm shank 137, spring plate 125, and spring 123. Rotation of handle 155 the other direction may allow return spring 130 to cause retraction of dart 113.

Figure 4:
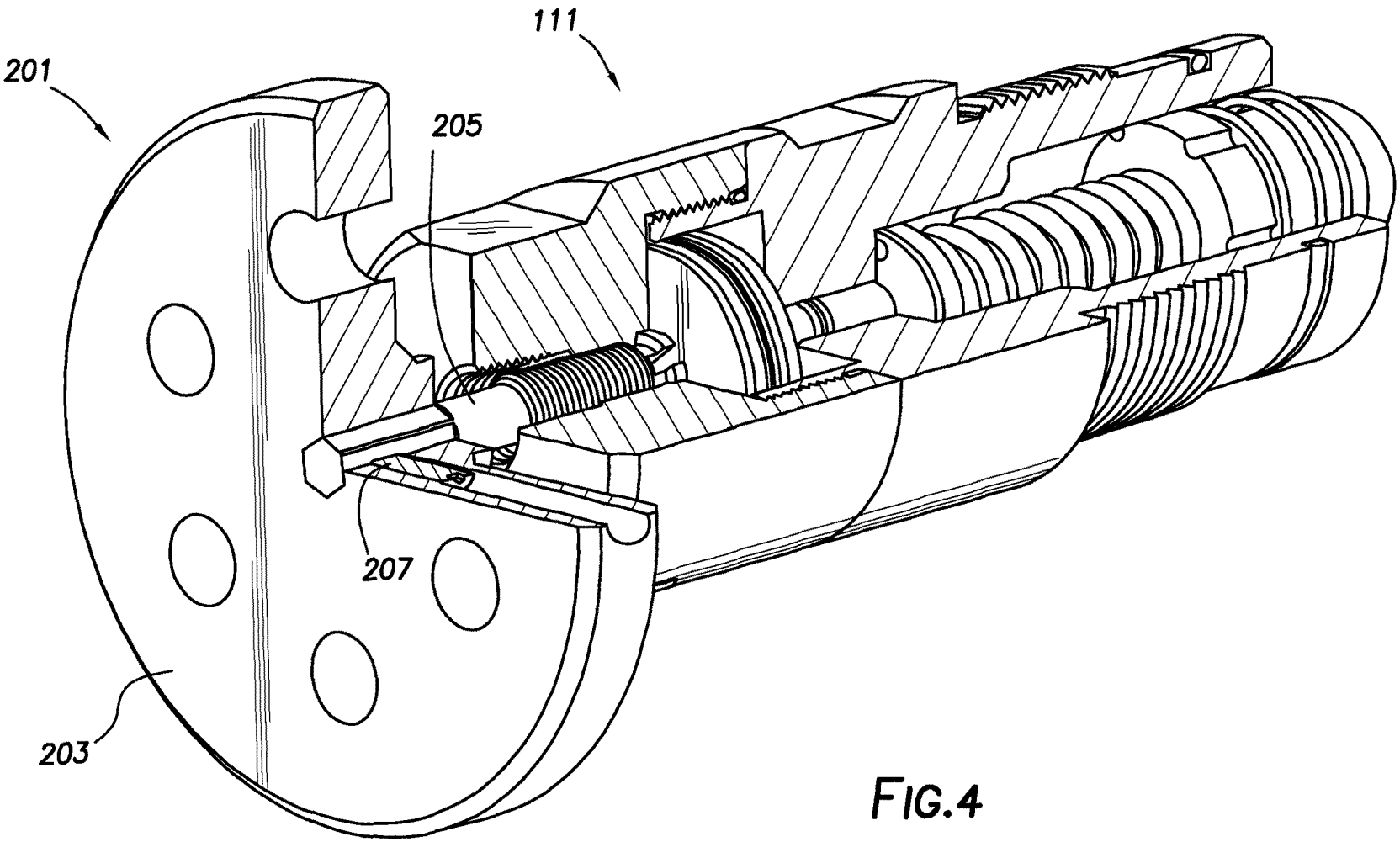
FIG. 4 depicts a perspective cut away view of a plunger catch in a manual configuration consistent with at least one embodiment of the present disclosure.

In some embodiments, handle 155 may be substantially T-shaped as previously described. One having ordinary skill in the art with the benefit of this disclosure will understand that handle 155 may be formed in any geometry suitable for use as a handle. For example, FIG. 4 depicts handle assembly 201 for lubricator 100 according to at least one embodiment of the present disclosure. Handle assembly 201 may include handle body 203. Handle body 203 may be generally disc shaped. In some embodiments, handle assembly 201 may be coupleable to adjusting pin 205. Adjusting pin 205 may include a milled portion which may have a polygonal or splined shape, such as, as depicted in FIG. 4, a hexagonal cross section. Handle body 203 may include a correspondingly broached hole adapted to receive adjusting pin 205. In some embodiments, grub screw 207 may be positioned within handle body 203 to retain handle body 203 to adjusting pin 205.

In order to reconfigure between the pneumatic configuration and manual configuration, with reference to FIGS. 2, 3, in operation, catch end cap 121 may be unthreaded from catch housing 119. Seals 141, 143, and 145 may retain the pressure within dart cylinder 115. If previously in the pneumatic configuration, pneumatic line 149 may be removed from pneumatic line coupler 151, and adjusting pin 157 may be threaded into control aperture 147 of catch end cap 121, thus attaching handle assembly 153 to catch end cap 121. Catch end cap 121 may then be reattached to catch housing 119.

When in the manual configuration, plunger catch assembly 111 may be converted to the pneumatic configuration by removing catch end cap 121 from catch housing 119, unthreading adjusting pin 157 from control aperture 147, attaching pneumatic line 149 to pneumatic line coupler 151, and recoupling catch end cap 121 to catch housing 119.

Figure 5A:
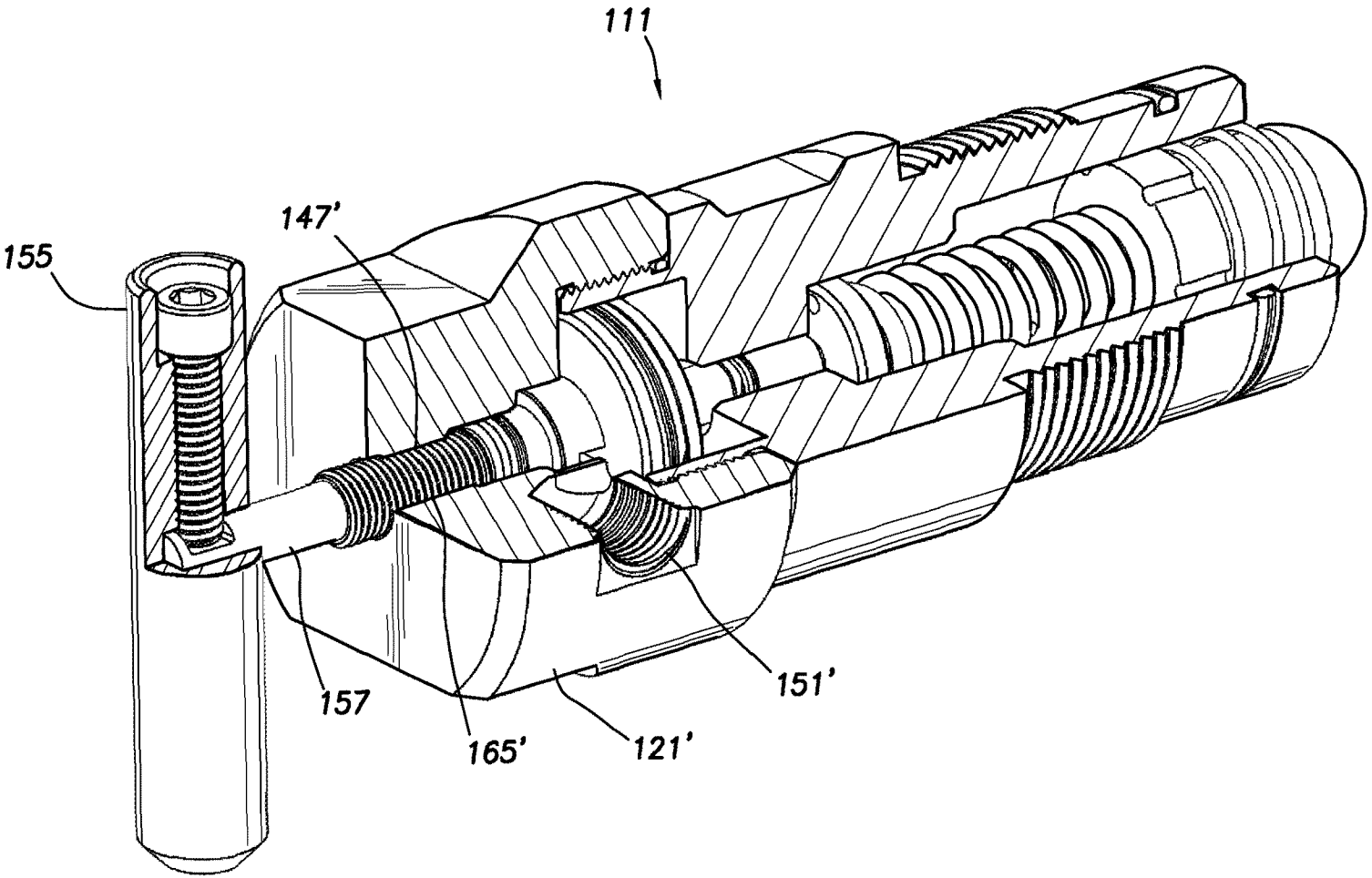
FIG. 5A depicts a perspective cut away view of a plunger catch consistent with at least one embodiment of the present disclosure.
Figure 5B:
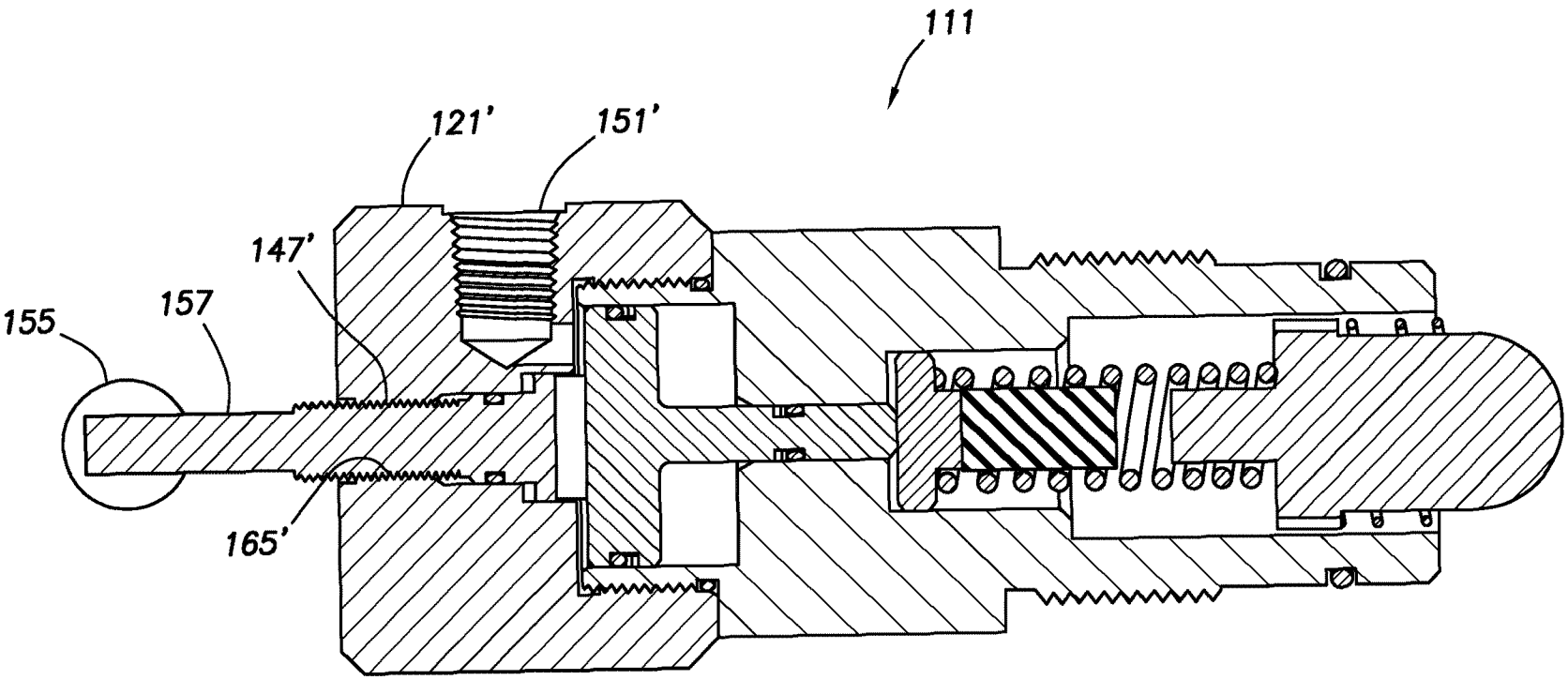
FIG. 5B depicts a cross section view of the plunger catch of FIG. 5A.

In some embodiments, plunger catch assembly 111 may be designed such that both pneumatic and manual operation may be utilized without reconfiguration of plunger catch assembly 111. For example, as depicted in FIGS. 5A, 5B, plunger catch assembly 111 may include catch end cap 121' having separate apertures formed for pneumatic line coupler 151' and control aperture 147'. Control aperture 147' may include machine threads 165' which engage adjusting pin 157. By separating pneumatic line coupler 151' from control aperture 147', a hydraulic line (not shown) may be coupled to pneumatic line coupler 151' while handle 155 remains attached. In such a configuration, plunger catch assembly 111 may be controlled manually by rotating handle 155 as discussed herein above. If adjusting pin 157 is fully retracted, pneumatic control of plunger catch assembly 111 may be achieved by supplying pressure through pneumatic line coupler 151' acting otherwise as described herein above with respect to the pneumatic configuration.

One having ordinary skill in the art with the benefit of this disclosure will understand that plunger catch assembly 111 as described herein may be utilized with any size of lubricator 100. Additionally, one having ordinary skill in the art with the benefit of this disclosure will understand that plunger catch assembly 111 may be retrofitted onto existing lubricators 100. Furthermore, one having ordinary skill in the art with the benefit of this disclosure will understand that the specific configuration described is merely exemplary and that modifications may be made without deviating from the scope of this disclosure.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A plunger catch assembly for a lubricator comprising:

a dart, the dart selectively extendable into the lubricator to catch a plunger;

a catch housing, the catch housing coupleable to the lubricator, the catch housing defining a dart cylinder, the dart slidingly positioned at least partially within the dart cylinder;

a catch end cap coupleable to the catch housing, the catch housing and catch end cap forming a diaphragm cylinder therein, the catch end cap including a machine thread adapted to receive a handle assembly and a pneumatic line coupler adapted to couple to a pneumatic line;

a diaphragm, the diaphragm slidingly positioned within the diaphragm cylinder, the diaphragm coupled to the dart such that movement of the diaphragm causes corresponding movement of the dart, the diaphragm adapted to move in response to a mechanical force from the handle assembly or a fluid pressure within the diaphragm cylinder from the pneumatic line, and wherein the diaphragm comprises a diaphragm shank, the diaphragm shank extending through a connector port formed in the catch housing; and a spring plate and a spring, the spring positioned between the dart and the spring plate, wherein the spring plate is in contact with the diaphragm shank such that movement of the diaphragm transfers motion to the dart via the diaphragm shank, the spring plate, and the spring.

2. The plunger catch assembly of claim 1, further comprising an elastomeric shock absorber positioned between the spring plate and the dart such that the shock absorber cushions any contact between the spring plate and the dart.

3. The plunger catch assembly of claim 1 wherein the plunger catch assembly comprises a manual configuration in which the handle assembly is coupled to the catch end cap and a pneumatic configuration in which the pneumatic line is coupled to the catch end cap, and the plunger catch assembly is reconfigurable between the two configurations.

4. The plunger catch assembly of claim 1 wherein the handle assembly includes a handle and an adjusting pin, the adjusting pin having an exterior thread adapted to couple with the machine thread of the catch end cap such that rotation of the handle extends or retracts the adjusting pin from the diaphragm cylinder.

5. The plunger catch assembly of claim 4, wherein the adjusting pin contacts the diaphragm and, in response to rotation of the handle in a first direction, presses against the diaphragm, causing extension of the dart.

6. The plunger catch assembly of claim 1 wherein the pneumatic line is positioned to selectively provide pressure into the diaphragm cylinder between the catch end cap and the diaphragm to provide pressure against the diaphragm, causing extension of the dart.

7. A plunger catch assembly for a lubricator comprising:

a dart, the dart selectively extendable into the lubricator to catch a plunger;

a catch housing, the catch housing coupleable to the lubricator, the catch housing defining a dart cylinder, the dart slidingly positioned at least partially within the dart cylinder;

a catch end cap coupleable to the catch housing, the catch housing and catch end cap forming a diaphragm cylinder therein, the catch end cap including a machine thread adapted to receive a handle assembly and a pneumatic line coupler adapted to couple to a pneumatic line;

a diaphragm, the diaphragm slidingly positioned within the diaphragm cylinder, the diaphragm coupled to the dart such that movement of the diaphragm causes corresponding movement of the dart, the diaphragm adapted to move in response to a mechanical force from the handle assembly or a fluid pressure within the diaphragm cylinder from the pneumatic line; and a dart return spring positioned between the dart and the lubricator to bias the dart into a retracted position.

8. The plunger catch assembly of claim 7 wherein the pneumatic line coupler comprises NPT threads.

9. A plunger catch assembly for a lubricator comprising:

a dart, the dart selectively extendable into the lubricator to catch a plunger;

a catch housing, the catch housing coupleable to the lubricator, the catch housing defining a dart cylinder, the dart slidingly positioned at least partially within the dart cylinder;

a catch end cap coupleable to the catch housing, the catch housing and catch end cap forming a diaphragm cylinder therein, the catch end cap including a machine thread adapted to receive a handle assembly and a pneumatic line coupler adapted to couple to a pneumatic line; and a diaphragm, the diaphragm slidingly positioned within the diaphragm cylinder, the diaphragm coupled to the dart such that movement of the diaphragm causes corresponding movement of the dart, the diaphragm adapted to move in response to a mechanical force from the handle assembly or a fluid pressure within the diaphragm cylinder from the pneumatic line;

wherein the pneumatic line coupler and the machine threads are formed in a single control aperture.

10. The plunger catch assembly of claim 9, further comprising an elastomeric shock absorber positioned between the spring plate and the dart such that the shock absorber cushions any contact between the spring plate and the dart.

11. The plunger catch assembly of claim 9 wherein the plunger catch assembly comprises a manual configuration in which the handle assembly is coupled to the catch end cap and a pneumatic configuration in which the pneumatic line is coupled to the catch end cap, and the plunger catch assembly is reconfigurable between the two configurations.

12. The plunger catch assembly of claim 9 wherein the handle assembly includes a handle and an adjusting pin, the adjusting pin having an exterior thread adapted to couple with the machine thread of the catch end cap such that rotation of the handle extends or retracts the adjusting pin from the diaphragm cylinder.

13. The plunger catch assembly of claim 12 wherein the adjusting pin contacts the diaphragm and, in response to rotation of the handle in a first direction, presses against the diaphragm, causing extension of the dart.

14. The plunger catch assembly of claim 9 wherein the pneumatic line is positioned to selectively provide pressure into the diaphragm cylinder between the catch end cap and the diaphragm to provide pressure against the diaphragm, causing extension of the dart.

15. A method comprising:

providing a lubricator having a plunger catch assembly coupled thereto, the plunger catch assembly including:

a dart, the dart adapted to selectively extend into the lubricator to catch a plunger;

a catch housing, the catch housing coupled to the lubricator, the catch housing defining a dart cylinder, the dart slidingly positioned at least partially within the dart cylinder;

a catch end cap coupled to the catch housing, the catch housing and catch end cap forming a diaphragm cylinder therein;

a diaphragm, the diaphragm slidingly positioned within the diaphragm cylinder, the diaphragm coupled to the dart such that movement of the diaphragm causes corresponding movement of the dart, the diaphragm adapted to move in response to a mechanical force from a handle assembly or a fluid pressure within the diaphragm cylinder from a pneumatic line; and a return spring positioned between the dart and the lubricator;

wherein the handle assembly is operably coupled to a machine thread formed in the catch end cap;

removing the catch end cap from the catch housing;

removing the handle assembly from the catch end cap;

coupling the pneumatic line to a pneumatic line coupler formed in the catch end cap;

recoupling the catch end cap to the catch housing;

providing a pressure to the diaphragm cylinder with the pneumatic line;

moving the diaphragm;

extending the dart;

removing pressure from the diaphragm cylinder; and allowing the dart to retract using at least the return spring.

16. The plunger catch assembly of claim 15, further comprising an elastomeric shock absorber positioned between the spring plate and the dart such that the shock absorber cushions any contact between the spring plate and the dart.

17. The plunger catch assembly of claim 15 wherein the plunger catch assembly comprises a manual configuration in which the handle assembly is coupled to the catch end cap and a pneumatic configuration in which the pneumatic line is coupled to the catch end cap, and the plunger catch assembly is reconfigurable between the two configurations.

18. The plunger catch assembly of claim 15 wherein the handle assembly includes a handle and an adjusting pin, the adjusting pin having an exterior thread adapted to couple with the machine thread of the catch end cap such that rotation of the handle extends or retracts the adjusting pin from the diaphragm cylinder.

19. The plunger catch assembly of claim 18 wherein the adjusting pin contacts the diaphragm and, in response to rotation of the handle in a first direction, presses against the diaphragm, causing extension of the dart.

20. A method comprising:

providing a lubricator having a plunger catch assembly to the lubricator coupled thereto, the plunger catch assembly including:

a dart, the dart adapted to selectively extend into the lubricator to catch a plunger;

a catch housing, the catch housing coupled to the lubricator, the catch housing defining a dart cylinder, the dart slidingly positioned at least partially within the dart cylinder;

a catch end cap coupled to the catch housing, the catch housing and catch end cap forming a diaphragm cylinder therein;

a diaphragm, the diaphragm slidingly positioned within the diaphragm cylinder, the diaphragm coupled to the dart such that movement of the diaphragm causes corresponding movement of the dart, the diaphragm adapted to move in response to a mechanical force from a handle assembly or a fluid pressure within the diaphragm cylinder from a pneumatic line; and a return spring positioned between the dart and the lubricator;

wherein the pneumatic line is coupled to a pneumatic line coupler formed in the catch end cap;

removing the catch end cap from the catch housing;

removing the pneumatic line from the catch end cap;

coupling a handle assembly to a machine thread formed in the catch end cap; and recoupling the catch end cap to the catch housing;

rotating the handle assembly in a first direction;

contacting the diaphragm with an adjusting pin of the handle assembly;

moving the diaphragm by continued rotation of the handle assembly;

extending the dart;

rotating the handle assembly in a second direction; and allowing the dart to retract using at least the return spring.

* * * * *